United States Patent [19]

Billett et al.

[11] 4,020,879

[45] May 3, 1977

[54] POWER STRAPPING TOOL

[75] Inventors: Ronald J. Billett, Sunnyvale; Bruce M. Harper, San Jose, both of Calif.

[73] Assignee: FMC Corporation, Philadelphia, Pa.

[22] Filed: May 28, 1976

[21] Appl. No.: 691,257

[52] U.S. Cl. ..... 140/123.6; 140/93.2; 100/32

[51] Int. Cl.[2] ..... B21F 9/00

[58] Field of Search ..... 140/93.2, 93.4, 93.6, 140/123.5, 123.6; 254/51; 100/32

[56] References Cited

UNITED STATES PATENTS

| | | | |
|---|---|---|---|
| 3,066,706 | 12/1962 | Derrickson | 140/123.6 |
| 3,206,167 | 9/1965 | Armington | 254/51 |

*Primary Examiner*—Lowell A. Larson
*Attorney, Agent, or Firm*—Eugene G. Horsky; Pauline Newman; Eugene G. Seems

[57] ABSTRACT

A power strapping tool having an anvil and a tensioning wheel adapted to engage with overlapping portions of a strapping looped about a package and extending to a supply. The tensioning wheel is rotatable in a direction as to tension the loop of strapping and maintain such strapping tensioned while overlying portions thereof are connected to each other and then in an opposite direction to relax and flex away from the underlying strapping portion a span of the overlying strapping extending between such wheel and the location of strapping connection to thereby position such flexed, overlying strapping portion for easy severence. In the preferred embodiment, rotation of the tensioning wheel is also relied upon to effect projection of a knife between the overlying flexed and the underlying strapping portions and to then again tension the overlying strapping portion whereby the flexed strapping is urged against the projected knife to thereby sever the applied loop of strapped from its supply.

16 Claims, 13 Drawing Figures

POWER STRAPPING TOOL

The present invention relates to a power tool for tensioning a strapping looped about a package and for severing such tensioned looped of strapping from its supply.

Known in the art are strapping tools which utilize a power means for effecting tensioning of a strapping looped about a package or the like, yet rely upon manual manipulation of the tool itself or some cutting means to break or otherwise sever the applied tensioned loop from the strapping supply. Such power strapping tools generally have a number of protruding levers which must be actuated in a fixed sequence, making the use of such tools a slow, tedious and complicated task. Also known are strapping tools which, while perhaps having more conveniently operated levers, require that the strapping ends be laced through separate and torturous paths. Either tool type may well lead the operator to fatigue and inefficiency. Accordingly, a primary object of this invention is to provide a new or generally improved and more satisfactory power tool for tensioning a strapping looped about a package and for severing such tensioned loop from a supply of strapping.

Another objective is to provide a tool having means whereby a strapping may be laced through the tool in a simple overlapping manner, yet which separates the upper strapping layer so as to facilitate severance of only such upper layer.

Sitll another object of this invention is the provision of a strapping tool in which a common power means is employed for tensioning a loop of strapping about a package and in severing such applied strapping loop from a strapping supply.

A further object of this invention is the provision of an improved power strapping tool which provides for tensioning and severance of a strapping in a desired sequence.

A still further object is to provide a strapping tool in which cutting means are automatically urged into position for severing a strapping at a desired stage during a sequence of tool operations.

A still further object of this invention is the provision of an improved power strapping tool which is simple in construction and use, and is adapted for repeated, reliable operation with a minimum of maintenance.

These and other objects and advantages of the invention are accomplished in accordance with the present invention by a power strapping tool in which a common power source is used to effect the tensioning of a strapping, such as molecularly oriented plastic strapping, looped about a package and, also, in the severance of such tensioned loop from a strapping supply after connection of the end with an overlying portion thereof.

More particularly, the tool of the present invention has a main body on which is mounted a swingable anvil assembly and a rotatable wheel which are adapted to engage, respectively, with an end portion, and an overlapping intermediate portion of strapping looped about a package and extending to a supply. A power means, such as an air motor, serves to rotate the wheel first in one direction so as to draw the upper strapping layer only and thereby tension the loop of strapping and maintain the same tensioned as overlapping portions thereof are connected to each other at a location removed from such wheel, and then in an opposite direction to relax and flex the overlying layer of strapping away from the underlying layer, causing a separation of the two such strapping layers. At this stage the operator may insert a hand-held knife or blade of a pair of conventional scissors in between the upwardly flexed overlying strapping layer or portion and the underlying strapping layer and sever the overlying layer in the conventional manner.

In the preferred embodiment, means for cutting the overlying strapping layer are automatically inserted in between the upwardly flexed overlying strapping layer and the underlying layer. More specifically, carried by the anvil assembly is a knife which is movable between retracted and projected positions and, in the latter position, extends across the strapping path. By means of a lost motion connection, the wheel effects projection of the knife as such wheel completes relaxation of the strapping, and thus the projected knife lies between the underlying and the flexed overlying strapping portions or layers. Upon rotating the wheel so as to again tension the strapping, the flexed span thereof engages with and is severed by the knife, whereby the loop of strapping applied to the package is separated from the strapping supply. With the use of conventional molecularly oriented plastic strapping, clean severance of strapping over extended periods of use can generally be achieved.

The knife is swingably mounted on the anvil assembly, being releasably retained in its retracted position and resiliently biased toward its projected position. Knife retraction is achieved by a manual actuating lever which is mounted on the anvil assembly for movement relative to and together with such assembly. Movement of such lever relative to the anvil assembly is limited and effects knife retraction, while movement of such lever together with the anvil assembly serves to separate such assembly from the opposing rotatable wheel and thereby facilitates easy removal and easy lacing of strapping therebetween.

In the drawing, FIG. 1 is a shortened side view of the tool of the present invention, with portions thereof broken away;

Figure 1:
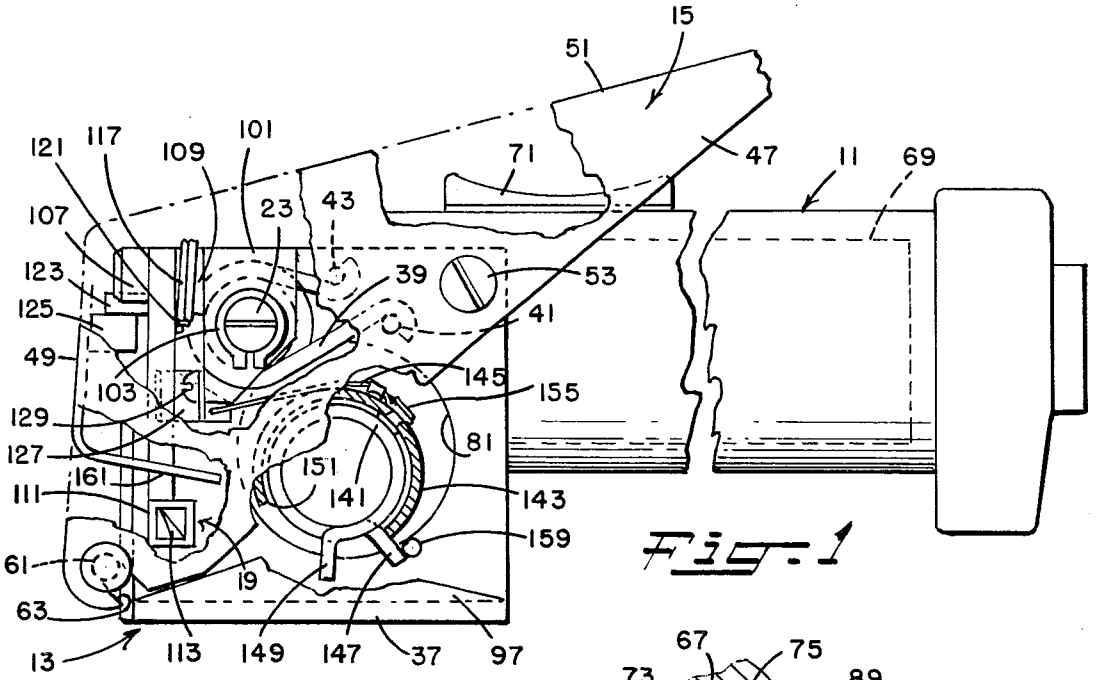
Figure 3:
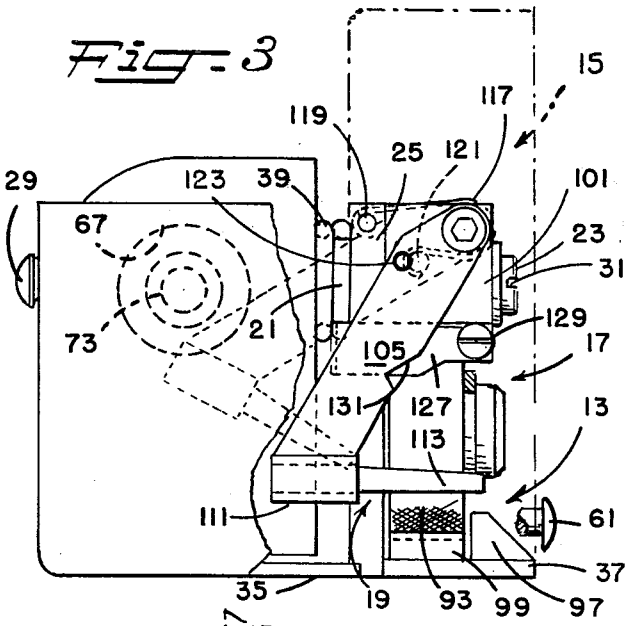
FIG. 3 is a view of the left end of the tool shown in FIG. 1, with a portion thereof broken away.
Figure 2:
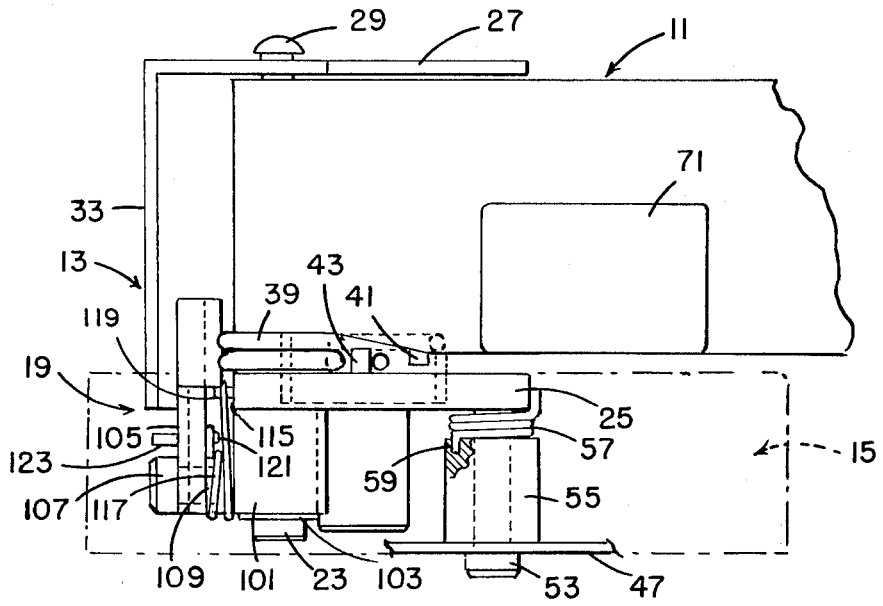
FIG. 2 is a plan view of a portion of the tool shown in FIG. 1.

With reference to FIGS. 1, 2 and 3 of the drawing, the preferred enbodiment of the tensioning tool of the present invention includes a main body 11, an anvil assembly 13, an anvil actuating lever 15, a strap tensioning mechanism 17, and a strapping cutting means 19.

As best shown in FIGS. 2 and 3, formed integrally with the main body 11 is a boss 21 having a bore which receives a shaft 23 on which is pivotally mounted a side wall 25 of the anvil assembly 13. An opposing side wall 27 of the assembly 13 is also pivotally supported from the main body 11 by a button head screw 29 which is threaded axially into the shaft 23, with the exposed end of the latter being provided with a slot 31 to facilitate this connection. The anvil assembly 13 includes also a front wall 33, a bottom wall 35 and an anvil 37 which projects laterally from the side wall 25, with the lowermost surfaces of the bottom wall 35 and anvil 37 being substantially coplanar and adapted to engage with a package to which strapping is to be applied.

Figure 5:
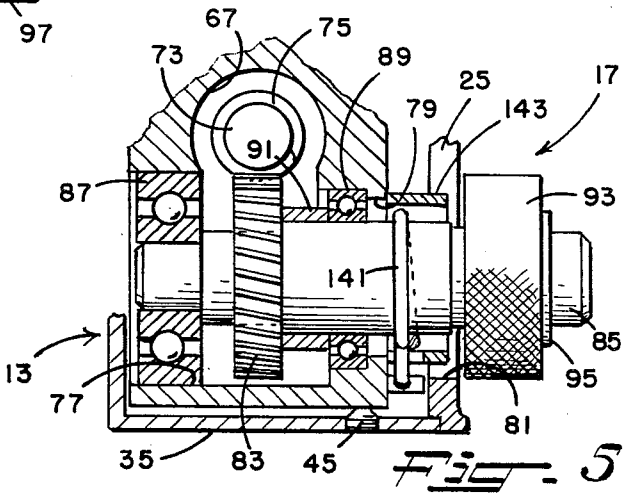
FIG. 5 is a vertical section taken transversely through the tool shown in FIGS. 1 and 2.

As viewed in FIG. 1, the anvil assembly 13 is biased in a counterclockwise direction by a spring 39 which encircles the boss 21 and has its opposite ends engaged with pins 41 and 43 which are fixed to and project from the main body 11 and the assembly side wall 25, respectively. Referring to FIG. 5, serving to limit such movement of the anvil assembly 13 is a set screw 45 which is threaded into the assembly bottom wall 35 and is adapted to engage with the main body 11.

Figure 9:
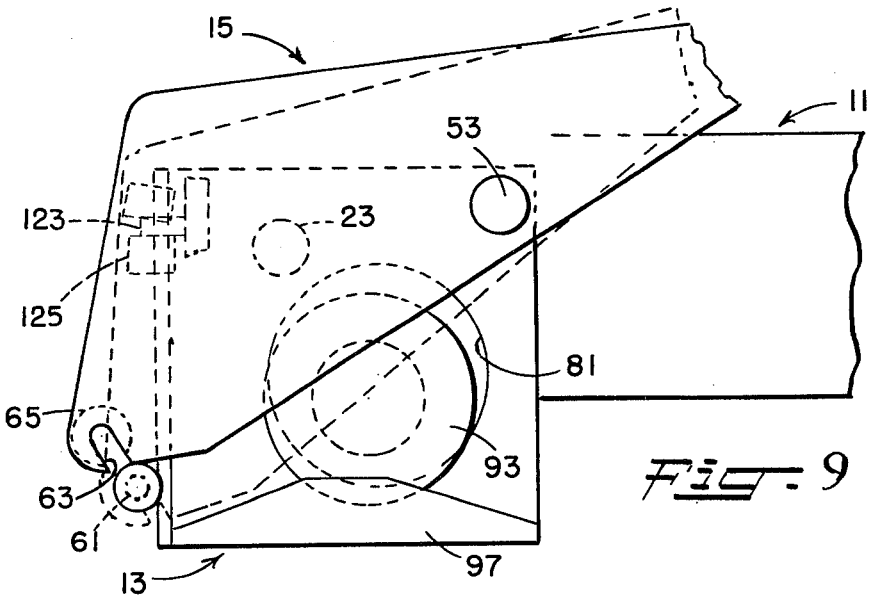
FIGS. 9 and 10 are views similar to FIG. 1 showing portions of the tool in different positions.
Figure 10:
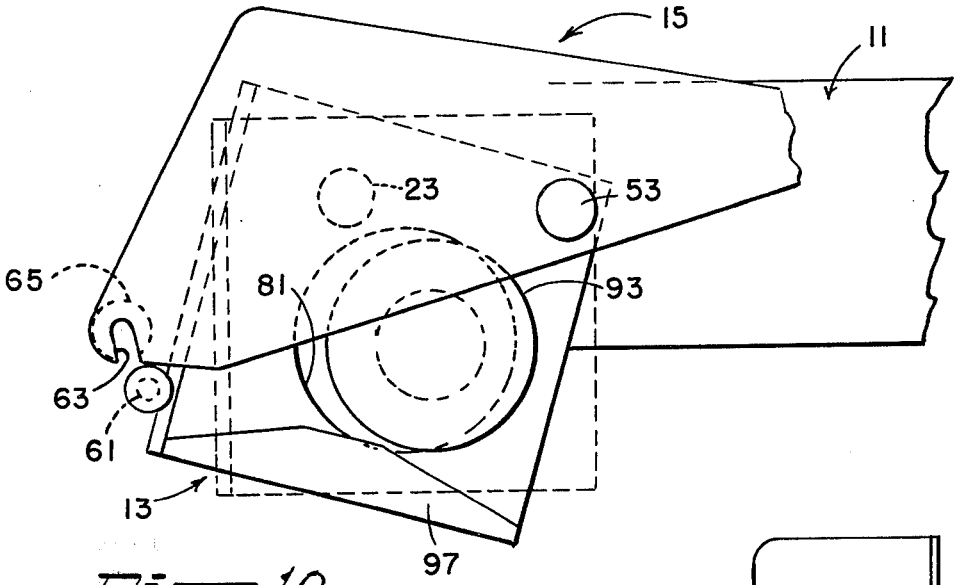
Figure 6:
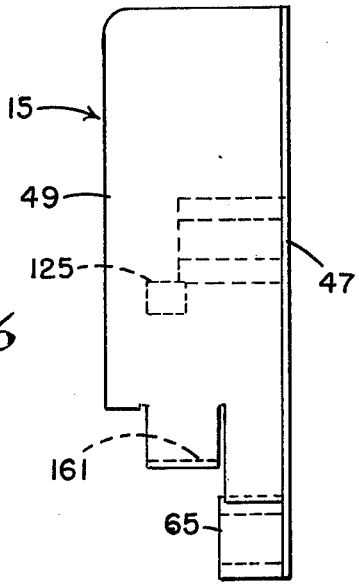

The actuating lever 15 includes a side wall 47, a front wall 49 and a top wall 51, and is pivotally connected to the anvil assembly 13 by a shoulder screw 53. More particularly, and as shown in FIG. 2, the screw 53 extends through the lever side wall 47, and an annular boss 55 fixed to such wall 47 and it threaded into the side wall 25 of the assembly 13. A torsion spring 57 encircles the shank of the screw 53, with one of its ends being seated within an opening 59 in the boss 55, and its opposite end engaged with the trailing edge of the assembly side wall 25. The spring 57 urges the lever 15 in a counterclockwise direction, as viewed in FIG. 1, relative to the assembly 13, with such movement being limited by a pin 61 located near the lowermost portion of the lever free end and welded or otherwise fixed to the front wall the 33 of the assembly 13. The lever side wall 47 is slotted at 23 for reception of the pin 61 and, as shown in FIGS. 6, 9 and 10, is provided with a segment bearing 65, fixed to both such side wall 47 and the lever front wall 49, for engaging with such pin 61.

Referring to FIGS. 1 and 5, the main body has an internal cavity 67 within which is disposed a conventional reversible motor and preferably an air motor, indicated at 69, or other suitable driving means. The operation of the air motor 69 is controlled by a thumb switch 71 and as shown in FIG. 5 has a drive shaft 73 to which is fixed a worm gear 75.

Formed also in the main body 11 and leading into the cavity 67 are coaxial openings 77 and 79 which are eccentric relative to an aligned opening 81 formed in the side wall 25 of the anvil assembly 13. Meshing with the drive shaft worm gear 75 is a worm gear 83 fixed to a shaft 85 which is supported by bearings 87 and 89. As seen in FIG. 5, the bearing 89 is seated within a recessed portion of the opening 79 and is retained in a position by a bearing spacer 91. Keyed onto a reduced diameter portion of the projecting end of the shaft 85, so as to overlie the anvil 37, is a tensioning wheel 93 having a serrated strap gripping peripheral surface, with a retainer 95 serving to prevent wheel movement relative to the shaft 85.

Figure 4:
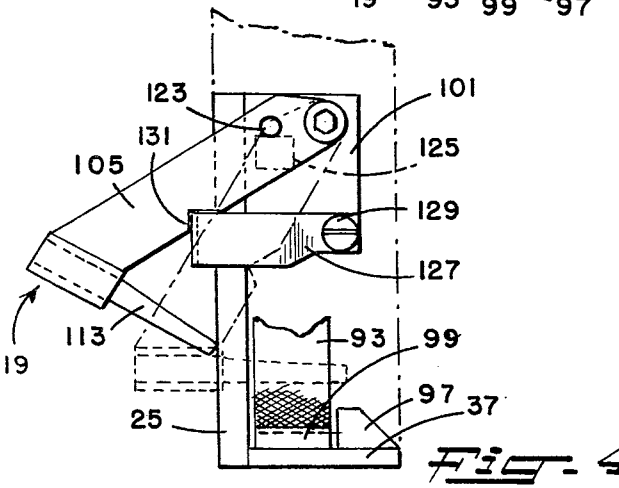
FIG. 4 is a view similar to FIG. 3 with elements of the tool in a different position.

As best seen in FIG. 1, 3 and 4, the anvil 37 includes an upstanding wall 97 which, with the assembly wall 25, defines a channel within which is disposed an anvil pad 99. The uppermost surface of the pad 99 is at all times spaced from the surface of the tensioning wheel 93 and is serrated or otherwise roughened, while the outermost surfaces of the wall 97 are inclined or tapered to facilitate the insertion of strapping between the tensioning wheel 93 and anvil pad 99.

The strapping cutting means 19 is best illustrated in FIGS. 1–4 and includes a pivot block 101 which is mounted on the shaft 23 and is fixed to rotate with the anvil assembly 13. The block 101 is maintained on the shaft 23 by a retainer 103 and is formed with a tapered face so as to avoid contact with the tensioning wheel 93. One end of a knife arm 105 is swingably mounted on the block 101 by a screw 107 and spacer 109, and carries at its opposite end a sleeve 111 in which is releasably retained a knife 113. Turning to FIG. 2, the edge 115 of the side wall 25 of the anvil assembly 13 is spaced away from the assembly front wall 33 to accommodate the swinging movement of the arm 105.

Movement of the knife arm 105 from its retracted position shown in FIG. 4 to its projected position shown in FIG. 3, locates the knife 113 across the path of the strapping and is achieved by a spring 117 which is encircled about the spacer 109 and has its ends looped about pins 119 and 121 fixed to the assembly wall 25 and knife arm 105. Retraction of the knife arm 105 is achieved by a roll pin 123 which projects from such arm in position to be engaged by a lug 125 fixed to the inside surface of the front wall 49 of the lever 15. Depression of the lever 15 against the bias of the spring 57; that is, from its broken line position to its solid line position shown in FIG. 9, causes the lug 125 to elevate the roll pin 123 and thereby swing the knife arm 105 from a position as shown in FIG. 3 to that shown in FIG. 4. The knife arm 105 is held in its retracted position by a blade spring retainer 127 which is fixed by a screw 129 to the pivot block 101 and is adapted to seat within a notch 131 formed in the knife arm 105. Upon release of the lever 15, the spring 57 returns the lever 15 to its broken line position in FIG. 9.

Figure 7:
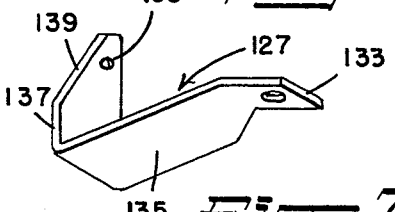

As shown in FIG. 7, the retainer 127 is bent to provide three angularly disposed sections 133, 135 and 137, with the section 133 facilitating retainer attachment to the pivot block 101, the inclined section 135 serving to position the section 137 in the path of the knife arm 105 and the section 137 being adapted to seat within the notch 131 of such knife arm. During retraction, the knife arm 105 engages with the retainer section 137, deflects the free portion of the retainer away from its path and, after retraction of the knife arm is completed, such retainer free portion is resiliently returned to its original position whereby its section 137 seats within the notch 131 in the knife arm 105. Again as seen in FIG. 7, the uppermost edge of the retainer section 137 is inclined at 139 to permit the desired deflection without contact with the other elements, such as the spring 39.

Figure 8:
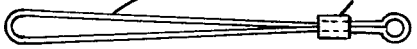
FIGS. 6, 7 and 8 are detail views of elements of the tool shown in FIGS. 1–4.

Referring to FIGS. 1 and 5, release of the blade arm 105 is accomplished by a lost-motion means which includes a clutch spring 141, a tension ring 143 and a tension wire 145, the latter of which is shown in FIG. 8. The clutch spring 141 grips onto the shaft 85 and has terminal portions 147 and 149 which are spaced circumferentially of the spring 141 and project generally radially therefrom. On the other hand, the tension ring 143 loosely encircles the spring 141 and is formed with an arcuate opening 151 which receives the projecting terminal portions 147 and 149 of the clutch spring 141. The tension wire 145 is laced through an opening 153 in the knife arm retainer 127, and is looped about a rivet 155 extending through the tension ring 143 with its ends and in intermediate section of such wire being fixed by a clenched sleeve 157.

As hereafter described in detail, strapping looped about a package is tensioned as the shaft 85 and the wheel 93 attached thereto are rotated in a counterclockwise direction, as viewed in FIG. 1. During such rotation, the clutch spring 141 grips and rotates with the shaft 85, with its terminal portion 147 engaging with and likewise rotating the tension ring 143, whereby the tension wire 145 assumes an unstressed condition. This concomitant counterclockwise rotation of the shaft 85, clutch spring 141 and tension ring 143 continues through a small arc and only until the terminal portion 147 of the clutch spring 141 contacts with a fixed pin 159 projecting from the assembly side wall 25. At this stage, the clutch spring 141 expands with continued counterclockwise rotation of the shaft 85 so that such spring 141 and the tension ring 143 remain stationary, due to the reduction of gripping force in the clutch spring.

Once strapping applied to a package has been tensioned as described above, and a seal has been clenched onto overlying portions of such tensioned strapping as hereafter discussed, the direction of drive of the air motor 69 is reversed to rotate the shaft 85, and the attached wheel 93, in a clockwise direction, as viewed in FIG. 1. The clutch spring 141 now contracts so as to again grip and rotate with the shaft 85. The tension ring 143, however, remains stationary until the terminal portion 149 of the clutch spring 141 is engaged with the tension ring 143. During this stage, the clockwise rotation of the wheel 93 causes the span of the overlying strapping extending between the applied seal and the wheel 93 to first relax and then flex upwardly. With continued clockwise rotation of the shaft 85, all lost motion is consumed whereupon the clutch spring 141 transmits a like rotation to tension ring 143, causing the tension wire 145 to be stressed and ultimately flex the free end of the retainer 127 away from the path of the knife arm 105. Note that the degree of lost motion is chosen so that the space between strapping created by the "upflexing" is adequate enough for unobstructed introduction of the knife.

At this stage, the bias of the tensioned spring 117 urges the knife arm 105 in a counterclockwise direction, as viewed in FIG. 4, to thus project the knife 113 across the strapping path. Of significance, and as shown in FIGS. 1 and 6, a portion of the lever front wall 49 is bent to provide an arm 161 which overlies but is spaced from the strapping path. The arm 161 serves as an abutment which minimizes upward flexing of the overlying strapping portion and causes the same to flatten or widen, thus assuring free passage of the knife 113 between the flexed and underlying strapping portions.

It will be apparent that by using only one hand an operator can depress the lever 15 to facilitate lacing of strapping through the tool and, with the thumb of the same hand, actuate the switch 71 to effect rotation of the wheel sequentially in opposite directions.

In the use of the above described tool, a strapping 163 is manually looped by the operator about a package which is to be strapped, shown in part at 165, with the strap leading end 167 being overlapped by a portion thereof 169 extending to a supply. The operator then grips the tool body depressing the actuating lever 15 with the thumb of the same hand, first acting against the bias of the torsion spring 57 and subsequently against the action of the spring 39. During the initial movement of the lever 15, as shown in FIG. 9; that is counter to the influence of the torsion spring 57, the roll pin 123 is elevated by the lug 125 on the lever 15, thus retracting the knife arm 105 into a position as illustrated in FIG. 4, where it is held by the retainer 127. With continued depression of the lever 15, now against the bias of the spring 39, the anvil assembly 13 moves as a unit with the lever 15, as shown in FIG. 10, from a position indicated by broken lines to that shown in solid lines. The anvil 37 is now spaced from the tensioning wheel 93 and with his free hand the operator can insert the overlapping strap portions 167 and 169 laterally inbetween the wheel 93 and the anvil pad 99 without further lacing.

Figure 11:
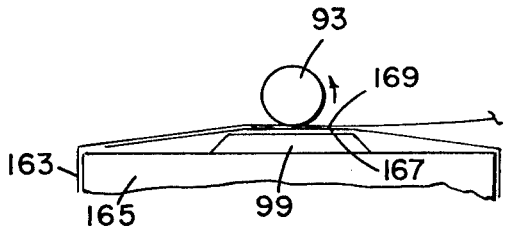
FIGS. 11, 12 and 13 are diagramatic views illustrating the sequence of the operations of the tool of the present invention.

Upon release of the lever 15, the anvil assembly 13 is biased by the spring 39 to its position as shown in FIG. 1 whereby the overlapping strap portions are gripped by the serrated surfaces on the periphery of the tensioning wheel 93 and anvil pad 99. The thumb switch 71 is now moved to operate the air motor 69 so as to drive the shaft 85, and tensioning wheel 93 fixed thereto, in a counterclockwise direction as viewed in FIG. 1. The wheel 93 thus moves the strap portion 169 relative to the underlying portion 167, as diagrammatically shown in FIG. 11, and tensions the loop of strapping against the package until the air motor 69 is stopped by stalling or by release of the thumb switch 71. The drive worm holds the wheel locked while a seal 171 is then clenched in the conventional manner onto overlapping portions of the tensioned strap.

Figure 12:
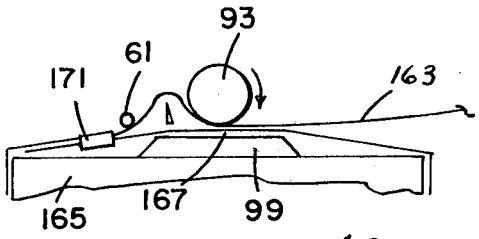

The thumb switch 71 is now actuated to cause the air motor 69 to rotate the tensioning wheel 93 clockwise as indicated in FIG. 12. Initially during this rotation of the wheel 93, the overlying strap portion 169 between such wheel 93 and the applied seal 171 is flexed upwardly and against the arm 161 of the lever 15 causing such flexed portion to spread apart or widen. Subsequently, the spring clutch 141 and tension ring 143 stress the tension wire 145 so as to release the retainer 127 from the knife arm 105. The spring 117 thus swings the knife arm 105 so as to project the knife 113 inbetween the upwardly flexed and underlying strapping portions. Of significance, and as shown in FIG. 12, while the entire span of strapping extending between the wheel 93 and seal 171 is relaxed during the rotation of the wheel 93 as indicated above, the presence of the pin 61 encourages the upward flexing of the strapping portion 169 to occur primarily in the area between such pin 61, the wheel 93 and the arm 161 of the lever 15. Thus, this pronounced upward flexure of the strapping portion 169 readily accommodates the knife 113.

Figure 13:
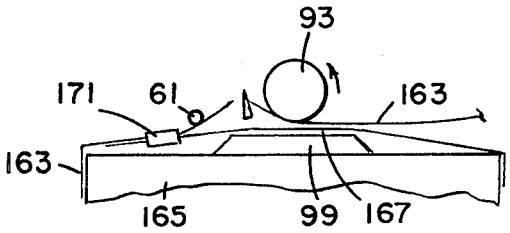

The thumb switch 71 is now operated to cause the air motor 69 to rotate the tensioning wheel 93 in the direction as indicated in FIG. 13, thus tensioning the overlying strap portion onto the cutting edge of the knife 113 to effect strap severance. The motor 69 is then stopped. As shown in FIG. 1, the surfaces defining the cutting edge of the knife 113 are inclined so as to (a) orient the blade substantially perpendicular to the direction in which the strapping is tensioned, and (b) to insure a progressive penetration of such knife 113 into the strapping as it is tensioned.

The anvil actuating lever 15 is now depressed by the operator through its solid line position shown in FIG. 9 and into that shown in FIG. 10. During the initial of such movements, the knife arm 105 is retracted as heretofore described by the cooperating roll pin 123 and lug 125. The subsequent movement of the lever 15 into its position shown in FIG. 10 serves to move the anvil assembly 13 away from the tensioning wheel 93 and facilitate removal of the tool laterally from the applied strap.

It is to be understood that changes and variations may be made without departing from the spirit and scope of the invention as defined in the appended claims.

We claim:

1. A tool for tensioning a length of strapping about a package and preparing the same for severence from a strapping supply, said tool having a main body, an assembly including an anvil mounted on said main body, a wheel, means supporting said wheel for rotation relative to said main body, said anvil and said wheel being adapted to engage, respectively, with an end portion and an overlapping intermediate portion of strapping looped about a package and extending to a supply, and means on said main body for rotating said wheel in one direction for tensioning the loop of strapping and maintaining the same tensioned during connection of overlapping portions thereof to each other at a location removed from said wheel, and in an opposite direction for flexing away from the underlying strapping portion a span of the overlying strapping portion extending between said wheel and the location of strapping connection.

2. A tool as defined in claim 1 further including a knife, means mounting said knife on said assembly for movement relative thereto between a retracted position and a projected position in which said knife extends across the strapping path, and means for projecting said knife between the flexed overlying and the underlying strapping portions whereby the overlying strapping portion may be severed from the supply as the flexed span thereof is again tensioned by rotation of said wheel.

3. A tool as defined in claim 2 further including a retainer for holding said knife in its retracted position and wherein said knife projecting means includes a lost-motion connection between said wheel rotating means and said retainer for releasing said retainer after a predetermined rotation of said wheel in said opposite direction.

4. A tool as defined in claim 2 wherein said knife mounting means is swingably supported on said assembly and wherein said knife projecting means include bias means for swinging said knife mounting means relative to said assembly to move said knife into its projected position.

5. A tool as defined in claim 2 wherein said assembly is swingably mounted on said main body and further including bias means acting on said assembly for urging said anvil into strapping engaging position, and an actuating lever mounted on said assembly for manually moving said assembly opposite to said bias means to permit lacing of overlapping strapping portions between said wheel and said anvil.

6. A tool as defined in claim 5 wherein said actuating lever is mounted on said assembly for swinging movement relative thereto into a first position and for movement with said assembly opposite to said bias means from said first position into a second position, and cooperating means on said knife mounting means and said actuating lever for retracting said knife from its projected position as said actuating lever is moved into its first position.

7. A tool as defined in claim 6 further including a retainer for holding said knife in its retracted position and wherein said knife projecting means includes a lost motion connection between said wheel rotating means and said retainer for releasing said retainer after a predetermined rotation of said wheel in said opposite direction.

8. A tool as defined in claim 6 wherein said knife mounting means is swingably supported on said assembly and wherein said knife projecting means includes bias means for swinging said knife mounting means relative to said assembly to move said knife into its projected position.

9. A tool as defined in claim 7 wherein said knife mounting means is swingably supported on said assembly and wherein said knife projecting means includes bias means for swinging said knife mounting means relative to said assembly to move said knife into its projected position.

10. A tool as defined in claim 9 wherein said wheel supporting means includes a shaft to which said wheel is fixed and bearings within which said shaft is mounted for rotation, and said wheel rotating means is a reversible motor for driving said shaft.

11. A tool as defined in claim 10 wherein said lost-motion connection includes a tension ring mounted on said shaft for relative movement therebetween, means connecting said tension ring with said retainer, and clutch means between said shaft and said tension ring for effecting movement of said tension ring only after a predetermined rotation of said shaft in said opposite direction.

12. A tool as defined in claim 11 wherein said clutch means includes a spring encircled about and gripping said shaft, the opposite ends of said spring being circumferentially spaced and projecting outwardly therefrom, a circumferential opening in said tension ring through which project the ends of said spring, said opening being longer than the circumferential spacing between the ends of said spring whereby said tension ring is engaged by one end of said spring after said shaft and spring are rotated through a predetermined degree in said opposite direction, and an abutment on said assembly for engaging with the opposite end of said spring and causing the spring to expand away from said shaft when said shaft is rotated in said one direction.

13. A tool as defined in claim 3 wherein said wheel supporting means includes a shaft to which said wheel is fixed and bearings within which said shaft is mounted for rotation, and said wheel rotating means is a reversible motor for driving said shaft selectively in said one and opposite directions.

14. A tool as defined in claim 13 wherein said lostmotion connection includes a tension ring mounted on said shaft for relative movement therebetween, means connecting said tension ring with said retainer, and clutch means between said shaft and said tension ring for effecting movement of said tension ring only after a predetermined rotation of said shaft in said opposite direction.

15. A tool as defined in claim 14 wherein said clutch means includes a spring encircled about and gripping said shaft, the opposite ends of said spring being circumferentially spaced and projecting outwardly therefrom, a circumferential opening in said tension ring through which project the ends of said spring, said opening being longer than the circumferential spacing between the ends of said spring whereby said tension ring is engaged by one end of said spring after said shaft and spring are rotated through a predetermined degree in said opposite direction, and an abutment on said assembly for engaging with the opposite end of said spring and causing the spring to expand away from said shaft when said shaft is rotated in said one direction.

16. A tool as defined in claim 13 wherein said motor is an air motor.

* * * * *

UNITED STATES PATENT AND TRADEMARK OFFICE

CERTIFICATE OF CORRECTION

PATENT NO. : 4,020,879

DATED : May 3, 1977

INVENTOR(S) : Ronald J. Billett and Bruce M. Harper

It is certified that error appears in the above-identified patent and that said Letters Patent are hereby corrected as shown below:

Column 3, line 24, "it" should read --is--; line35, "23" should read

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*